US006238836B1

(12) United States Patent
Nakamura et al.

(10) Patent No.: US 6,238,836 B1
(45) **Date of Patent: *May 29, 2001**

(54) TONER COMPOSITION AND DEVELOPER FOR ELECTROSTATIC IMAGE DEVELOPMENT

(75) Inventors: Masanobu Nakamura, Warabi; Toshiro Kogawara, Iwatsuki; Hideki Gambayashi, Ageo; Norio Aoki, Ohmiya; Yoshinori Shimane, Ichikawa; Ryozo Sugawara, Sodegaura; Kinji Shinzo, Sakura, all of (JP)

(73) Assignee: Dainippon Ink Chemicals, Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/401,783

(22) Filed: Sep. 22, 1999

(30) Foreign Application Priority Data

Sep. 25, 1998 (JP) ..... 10-271250

(51) Int. Cl.[7] ..... G03G 9/087
(52) U.S. Cl. ..... 430/110; 430/137
(58) Field of Search ..... 430/106, 109, 430/110, 111, 137

(56) References Cited

U.S. PATENT DOCUMENTS

| | | | | |
|---|---|---|---|---|
| 5,057,392 | * | 10/1991 | McCabe et al. | 430/109 |
| 5,112,715 | | 5/1992 | DeMejo et al. . | |
| 5,147,747 | | 9/1992 | Wilson . | |
| 5,780,195 | | 7/1998 | Nava . | |
| 5,908,727 | * | 6/1999 | Kawaji et al. | 430/111 |

FOREIGN PATENT DOCUMENTS

| | | |
|---|---|---|
| 0 617 377 A2 | 9/1994 | (EP) . |
| 0 716 351 A2 | 6/1996 | (EP) . |
| 2 237 399 | 1/1991 | (GB) . |
| 62-215962 | 9/1987 | (JP) . |
| 62-295068 | 12/1987 | (JP) . |
| 2-266364 | 10/1990 | (JP) . |
| 3-7948 | 1/1991 | (JP) . |
| 5-119509 | 5/1993 | (JP) . |
| 6-118706 | 4/1994 | (JP) . |
| 8-27554 | 3/1996 | (JP) . |
| 8-33683 | 3/1996 | (JP) . |
| WO 97/49006 | 12/1997 | (JP) . |
| 2858123 | 12/1998 | (JP) . |
| 11-15199 | 1/1999 | (JP) . |

* cited by examiner

*Primary Examiner*—John Goodrow
(74) *Attorney, Agent, or Firm*—Armstrong, Westerman, Hattori, McLeland & Naughton, LLP

(57) ABSTRACT

An electrostatic image developer is provided which has superior fixation properties and anti-offset properties, exhibits stable charge behavior even during continuous printing, and has superior durability and permits a high-quality image to be obtained. This electrostatic image developer is a toner composition containing colored resin particles comprising at least a binder resin, a colorant, and a charge control agent, wherein (1) an epoxy compound with a valence of 5 or more, (2) a polybasic acid compound having a valence of 2 or more selected from the group consisting of polybasic acids and/or acid anhydrides and/or lower alkyl esters thereof, and (3) a polyvalent alcohol having a valence of 2 or more, are employed as chief structural components of the binder resin, and a polyester resin is produced by reacting components (1)–(3) simultaneously, or by first reacting components (1) and (3), and subsequently reacting component (2), or by first reacting components (1) and (2), and subsequently reacting component (3).

15 Claims, 1 Drawing Sheet

TONER COMPOSITION AND DEVELOPER FOR ELECTROSTATIC IMAGE DEVELOPMENT

BACKGROUND OF THE INVENTION

1. Field of the Invention

The present invention relates to an electrostatic image developer which is employed in electrophotographic methods, electrostatic recording methods, and electrostatic printing methods.

This application is based on Japanese Patent Application No. Hei 10-271250 filed in Japan, the content of which is incorporated herein by reference.

2. Description of Related Art

Various electrophotographic methods have been disclosed in, for example, U.S. Pat. No. 2,297,691, Japanese Patent Application, Second Publication No. Sho 42-23910, and Japanese Patent Application, Second Publication No. Sho 43-24748; commonly, an electrostatic latent image is formed on an electrostatic latent image bearing medium such as a photoconductive photosensitive medium or the like by means of charge or light exposure, and then this electrostatic latent image is developed using a toner composition containing a colorant in a binder resin, and the resulting toner image is transferred to a support medium such as transfer paper or the like and fixed, and a visible image is thus formed.

Furthermore, a large number of developing methods are known among electrophotographic methods; these can be broadly classified into two-component developing methods which employ, as a developer, a mixture of toner and a carrier comprising microparticles (20–500 micrometers) of, for example, iron powder, ferrite, nickel, glass, or the like, and single-component developing methods which employ a developer comprising only toner.

Representative examples of the two-component developing methods include the cascade method disclosed in U.S. Pat. No. 2,618,552, and the magnetic brush method disclosed in U.S. Pat. No. 2,874,063. In these methods, functions such as the agitation, conveyance, charging, and the like of the developer are apportioned to the carrier, so that the functional separation between the carrier and the toner is made clear. For this reason, the control of the charge of the toner and the formation of the developer layer are comparatively easy, and the method is capable of high speed, so that it is presently widely employed.

In recent years, in concert with the development of the information society, there have been increasing requirements for improvement in the quality of printed images, increase in recording speed, greater density, long term storage stability, and the like, in a variety of fields such as electrophotography, electrostatic recording, and electrostatic printing, and there has been a great desire for improvements in the characteristics of toner for recording electrostatic latent images on non-printing media. In particular, in toners employed in two-component developers which are used in high speed printing, the strength of the toner with respect to friction with the carrier, and stable fixing behavior in a broad range of temperatures in heat roller fixing methods, are important characteristics, and these characteristics are very frequently dependent on the characteristics of the binder resin which is employed in the toner composition.

Among single-component developing methods, for example, U.S. Pat. No. 4,336,318 discloses a magnetic single-component developing method for conducting development using an electrically insulating magnetic toner. In this method, a charge is introduced into the toner as a result of the frictional charge between the toner particles and the toner-bearing medium and the toner thin film forming member, or as a result of the frictional charge between the toner particles themselves, and an electrostatic latent image is deposited on the photosensitive medium.

This developing method does not employ a carrier, and does not require a device for controlling the mixing ratio between the carrier and the toner, so that it is advantageous in that the developing apparatus has a small size.

In this method, in order to form the magnetic brush of the toner on a metal sleeve, it is necessary to provide the appropriate magnetic characteristics to the toner itself, and for this reason, it is absolutely necessary that magnetic materials such as magnetite, ferrite, and the like be contained in the toner. The amount of these magnetic materials contained varies somewhat depending on the developing conditions and type of materials; however, an amount within a range of 30–60% by weight is common.

Accordingly, the fact that the proportion of binder resin which is contained in the toner powder is small in comparison with that in a two-component developing toner is disadvantageous from the point of view of the fixation properties. As a result of these circumstances, the development of a binder resin which is capable of exhibiting sufficient fixation properties even when the proportion of binder resin contained is low in a magnetic single-component developing method has been keenly desired.

On the other hand, in order to solve the problems in the single-component developing method employing magnetic toner in this manner, a non-magnetic single-component developing method has been proposed which does not require that the toner have magnetic properties. Various apparatuses have been devised employing such a method; in many of these, toner is deposited on a developing sleeve or the like by means of static electric power, and the toner is then conveyed to a latent image surface and developed.

In non-magnetic single-component developing methods, an electrophotographic powdered toner is employed which contains, as required components, a binder resin, a colorant, and a charge control agent; the binder resin employed in this method is, like the binder resin employed in other developing methods, required to have stability with respect to static electricity, durability during continuous printing, and stable fixing behavior over a wide range of temperatures.

The binder resins for toner which have been investigated include, for example, polystyrene, styrene-acrylic ester copolymer, styrene-butadiene copolymer, polyester, epoxy resin, polybutyral, xylene resin, coumarone-indene resin, and the like, and various proposals have been made for the design of such resins depending on the use thereof.

Generally, characteristics which are required in binder resins include a variety of characteristics such as charge, fixation characteristics, and the like; in particular, in binder resins which are employed in toner used in heat roller fixation, an improvement in the fixation properties with respect to the transfer paper, and the anti-offset properties with respect to the heat roll is required. In heat roller fixation, the toner particles which are electrostatically deposited on the transfer paper are fused by means of a passage through the pressurized and heated hot rollers, and are fixed on the transfer paper. When the surface temperature of the rollers is too low at this time, the toner particle layer as a whole is not sufficiently heated, and only that surface which comes into contact with the heated rollers is softened and deposited on the heated rollers. The toner on the transfer paper side is not softened, so that no adhesion force is produced, and as a result, almost all of the toner layer on the transfer paper moves to the fixing roller without being fixed on the transfer paper. This is termed a cold offset.

On the other hand, when the temperature on the roller surface is too high, the viscosity of the molten toner decreases, and in concert with this, the internal cohesive force of the molten toner layer also decreases precipitously and becomes less than the force of adhesion to the heating roller. As a result, the molten toner layer is ruptured and moves both to the transfer paper and to the fixing roller. This is termed the hot offset, and is a cause for the contamination of the heating roller. The toner deposited on the heat roller is retransferred to the transfer paper and causes contamination of parts other than the image, so that the quality of printing declines.

What is meant by anti-offset properties is the ability of the toner at certain temperatures to avoid giving rise to cold offset or hot offset; the binder resin employed in the toner is required to have offset resistance properties over a wide range of temperatures, and is required to have superior fixation properties.

In order to obtain the above object, a number of designs have been proposed; among these, in order to maintain the viscoelasticity during heating and melting, or to suppress the changes in viscosity resulting from fluctuations in temperature, techniques have been considered in which mechanisms are employed to broaden the molecular weight distribution, to provide crosslinking structures, and to make use of rubber elastic material. In the investigations to date, it has been widely known that polyester resin may be employed as a resin for heat roller fixation. This is the case in, for example, Japanese Patent Application, Second Publication No. Sho 52-25420, Japanese Patent Application, Second Publication, No. Sho 53-17496, Japanese Patent Application, Second Publication No. Sho 55-49305, Japanese Patent Application, First Publication No. Sho 55-38524, Japanese Patent Application, First Publication No. Sho 57-37353, Japanese Patent Application, First Publication No. Sho 58-11952, and the like. However, in the conventionally proposed inventions, a polyester resin which sufficiently achieves the anti-offset properties over a broad range of temperatures and the fixation properties which are currently sought has not been obtained.

In Japanese Patent Application, First Publication No. Sho 62-295068, an electrostatic image developer is disclosed which is characterized in that the following are employed as the electrostatic static image developing agent employing a polyester resin as the binder resin:

(1) an epoxy compound having a valence of 5 or more, (2) A polybasic acid compound having a valence of 2 or more selected from a group consisting of polybasic acid and/or acid anhydride and/or lower alkyl esters thereof, and (3) a polyvalent alcohol having a valence of 2 or more, and in that the polyester resin is obtained by first reacting components (2) and (3) and then reacting component (1).

However, a resin which is resistant to the shear within the developing apparatus, in particular during high speed printing, and which has sufficient fixing strength at low temperatures, and which furthermore has anti-offset properties at high temperatures, has not yet been discovered.

Additionally, in order to provide releasing properties from the heat roller during fixing, and in order to prevent the generation of offset, techniques have also been developed in parallel in which a releasing agent is included in the toner. To date, attention has centered on synthetic waxes such as polypropylene wax, polyethylene wax, and the like; however, examples have been disclosed in which a natural wax, such as montan wax, carnauba wax, rice wax, and the like have been employed, in Japanese Patent Application, First Publication No. Hei 1-238672, Japanese Patent Application, First Publication No. Hei 3-5764, and Japanese Patent Application, First Publication No. Hei 5-119509.

With respect to charge control agents, as well, various such agents have been considered, and a positive charge charge control agent or a negative charge charge control agent is selected depending on the development method and the polarity of the photosensitive medium. For example, nigrosine dyes and quaternary ammonium salt-compounds and the like are known as charge control agents which may be employed in positively charged toner which is employed in machines using high speed and highly durable selenium photosensitive media. Examples in which such positive charge charge control agents are used singly or in combination are disclosed in, for example, Japanese Patent Application, First Publication No. Hei 1-259371, Japanese Patent Application, First Publication No. Hei 3-7948, Japanese Patent Application, First Publication No. Hei 5-119509, and Japanese Patent Application, First Publication No. Hei 10-246991.

However, a discovery which exhibits all the characteristics required in the developing methods described above has not been disclosed in any of the referenced publications.

BRIEF SUMMARY OF THE INVENTION

The present invention has as an object thereof to provide an electrostatic image developer which has superior fixation properties and anti-offset properties, which exhibits stable charge behavior even during continuous printing, and which has superior durability, allowing good, high quality images to be obtained.

As a result of diligent research with the object of solving the problems described above, the present inventors have obtained the present invention.

In other words, in order to solve the problems described above, the present invention provides a toner composition for electrostatic image developing which is a toner composition containing colored resin particles comprising at least a binder resin, a colorant, and a charge control agent, wherein the binder resin is a polyester resin obtained using:

(1) an epoxy compound having a valence of 5 or more, (2) A polybasic acid compound having a valence of 2 or more selected from a group consisting of polybasic acid and/or acid anhydride and/or lower alkyl esters thereof, and (3) a polyvalent alcohol having a valence of 2 or more, by reacting components (1)–(3) all at once, or by first reacting components (1) and (3) and subsequently reacting component (2), or by first reacting components (1) and (2) and subsequently reacting component (3); the present invention also provides an electrostatic image developer which is characterized in being an electrostatic image developer comprising at least a magnetic carrier and colored resin particles containing at least a binder resin, a colorant, and a charge control agent, wherein the binder resin is a polyester resin obtained using:

(1) an epoxy compound having a valence of 5 or more, (2) A polybasic acid compound having a valence of 2 or more selected from a group consisting of polybasic acid and/or acid anhydride and/or lower alkyl esters thereof, and (3) a polyvalent alcohol having a valence of 2 or more, by reacting components (1)–(3) all at once, or by first reacting components (1) and (3) and subsequently reacting component (2), or by first reacting components (1) and (2) and subsequently reacting component (3).

In the present specification, what is meant by epoxy compounds which have a valence of 2, within a range of 2–4, or 5, are, respectively, compounds having 2, 2–4. or 5 epoxy groups in one molecule. Hereinbelow, epoxy compounds having a freely selected valence number n indicate compounds having a number of epoxy groups n per molecule.

In accordance with the present invention, polyester resin which is crosslinked by means of epoxy compounds having a valence of 5 or greater is used as the binder resin, so that, in comparison with polyester resins which are crosslinked by means of epoxy compounds having a valence within a range of 1–4, it is possible to obtain fixation properties and anti-offset characteristics which are superior over a broad temperature range. Furthermore, sufficient mechanical strength is present at the same time, so that there is resistance to abrasion with the carrier inside the developing apparatus, and it is thus possible to conduct continuous printing of high-density and high quality images without generating spent carrier.

DETAILED DESCRIPTION OF THE INVENTION

Figure 1:
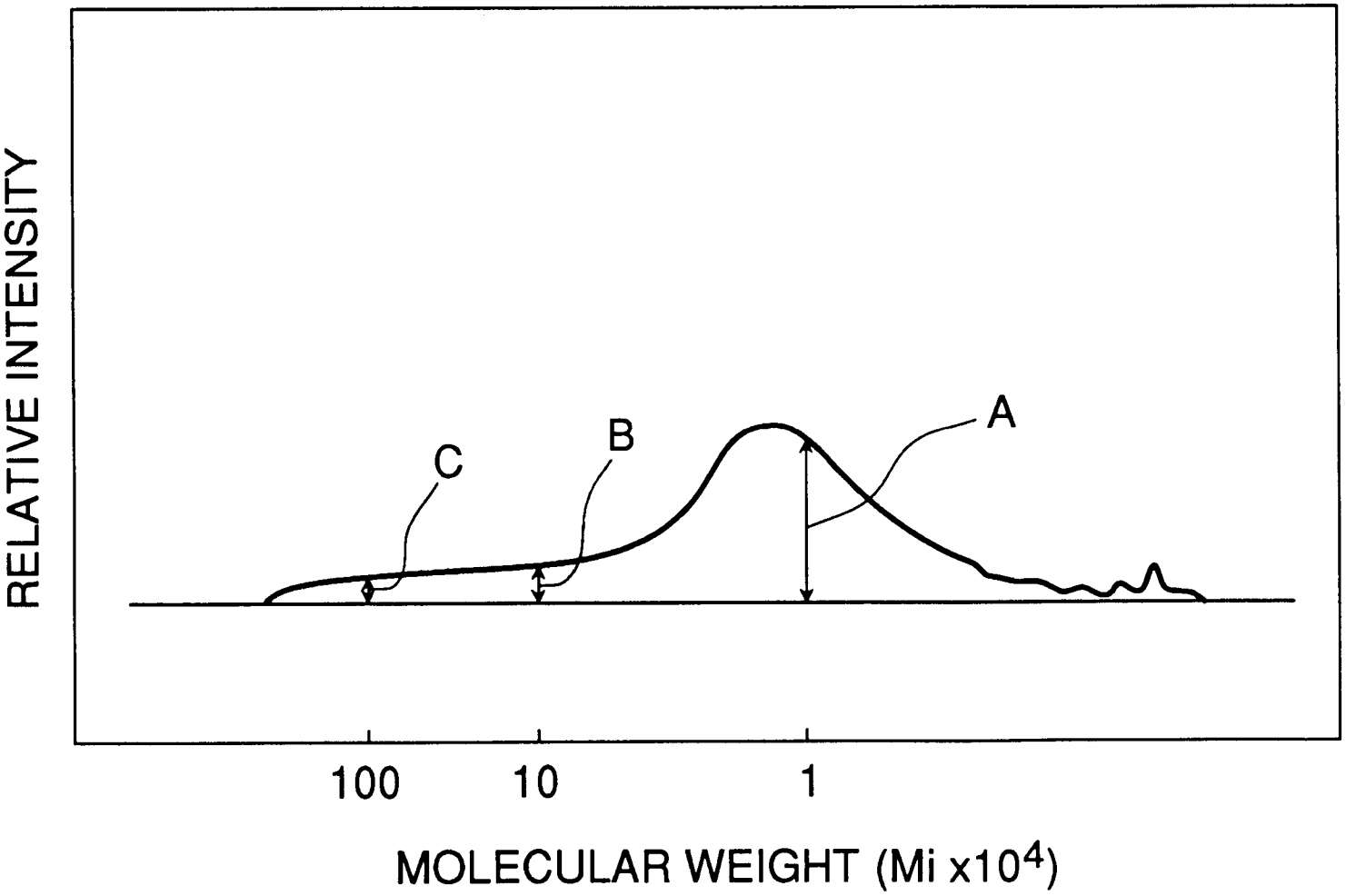
FIG. 1 is a diagrammatic graph showing GPC data measured with regard to a binder resin used in the present invention.

In the present invention, first, a toner composition is prepared containing colored resin particles comprising at least a binder resin, a colorant, and a charge control agent, and preferably a releasing agent; furthermore, a toner composition is employed in which microparticles having a smaller diameter than that of the colored resin particles are appropriately deposited thereon. In the present invention, the binder resin is a polyester resin, and is obtained from the following raw materials.

Examples of the epoxy compound (1) having a valence of 5 or greater employed in the present invention include, for example, cresol novolak type epoxy resins, phenol novolak type epoxy resin, a vinyl compound polymer or copolymer having epoxy groups, epoxylated resorcinol-acetone condensation product, partially epoxylated polybutadiene, and the like.

Concretely, examples of the orthocresol novolak type epoxy resin include, for example, Epiclon N-660, N-665, N-667, N-670, N-673, N-680, N-690, N-695, and the like produced by Dainippon Ink and Chemicals, Inc.

Examples of the phenol novolak type epoxy resin include, for example, Epiclon N-740, N-770, N-775, N-865, and like, produced by Dainippon Ink and Chemicals Inc. Examples of the vinyl compound polymer or copolymer containing epoxy groups include, for example, homopolymers of glycidyl (meth) acrylate, or acrylic copolymers thereof or copolymers with styrene.

Among these, cresol novolak type epoxy resins and phenol novolak type epoxy resins, which contain epoxy compounds having a valence of 5 or greater, are more preferably employed.

Furthermore, it is also possible to concomitantly employ two or more of the epoxy compounds described above, and furthermore, it is also possible to simultaneously employ the monoepoxy compounds described hereinbelow. Examples of monoepoxy compounds which may be simultaneously employed include, for example, phenyl glycidyl ether, alkyl phenyl glycidyl ether, alkyl glycidyl ether, alkyl glycidyl ester, the glycidyl ether of an alkyl phenol alkylene oxide addition product, α-olefin oxide, monoepoxy aliphatic acid alkyl ester, and the like.

By means of simultaneously employing these monoepoxy compounds, the fixation properties, and the anti-offset properties at high temperatures, can be improved. Among these, alkyl glycidyl ester is preferably employed.

Furthermore, epoxy compounds having a valence within a range of 2–4 may also be employed where appropriate. Examples of epoxy compounds having a valence within a range of 2–4 which may be employed simultaneously include, for example, bisphenol A-type epoxy resin, bisphenol F-type epoxy resin, bisphenol S-type epoxy resin, glycerin triglycidyl ether, trimethylol propane triglycidyl ether, trimethylol ethane triglycidyl ether, pentaerithrytol tetraglycidyl ether, and the like.

Examples of the polybasic acid compound (hereinbelow referred to as polybasic acid compound (2)) selected from a group consisting of polybasic acid and or acid anhydride and or lower alkyl esters thereof having a valence of 2 or greater which may be employed in the present invention include, for example, dicarboxylic acids such as phthalic anhydride, terephthalic acid, isophthalic acid, orthophthalic acid, adipic acid, maleic acid, maleic anhydride, fumaric acid, itaconic acid, citraconic acid, hexahydrophthalic anhydride, tetrahydrophthalic anhydride, cyclohexane dicarboxylic acid, succinic acid, malonic acid, glutaric acid, azelaic acid, sebacic acid, and the like, as well as derivatives or ester compounds thereof; furthermore, other examples thereof include polyvalent carboxylic acids having three or more functional groups such as trimellitic acid, trimellitic anhydride, pyromellitic acid, pyromellitic anhydride, and the like, as well as derivatives or ester products thereof.

As described above, examples of these polybasic acid compounds (2) include both polybasic acid compounds having addition polymerization properties, such as maleic acid or fumaric acid, and polybasic acid compounds which do not have addition polymerization properties, such as terephthalic acid and adipic acid; however, in the present invention, the use of only those polybasic acid compounds which do not have addition polymerization properties as polybasic acid compound (2) is preferable.

Furthermore, examples of the polyvalent alcohol (3) having a valence of 2 or more include, for example, diols such as 1,4-cyclohexane dimethanol, ethylene glycol, diethylene glycol, propylene glycol, dipropylene glycol, tripropylene glycol, butane diol, pentane diol, hexane diol, bisphenol A, polyoxyethylene-(2.0)-2,2-bis(4-hydroxyphenyl) propane and derivatives thereof, polyoxypropylene-(2.0)-2,2-bis(4-hydroxyphenyl) propane, polyoxypropylene-(2.2)-polyoxyethylene-(2.0)-2.2-bis(4-hydroxyphenyl) propane, polyoxypropylene-(6)-2.2-bis(4-hydroxyphenyl) propane, polyoxypropylene-(2.2)-2,2-bis (4-hydroxyphenyl) propane, polyoxypropylene-(2.4)-2,2-bis (4-hydroxyphenyl) propane, polyoxypropylene-(3.3)-2,2-bis(4-hydroxyphenyl) propane and derivatives thereof, polyethylene glycol, polypropylene glycol, ethylene oxide-propylene oxide random copolymer dial, ethylene oxide-propylene oxide block copolymer dial, ethylene oxide-tetrahydrofuran copolymer diol, polycaprolactone dial, and the like, and furthermore include polyvalent alcohols having three or more functional groups such as sorbitol, 1,2,3,6-hexane tetraol, 1,4-sorbitan, pentaerythritol, 1,2,4-butane triol, 1,2,5-pentane triol, glycerin, 2-methyl propane triol, 2-methyl-1,2,4-butane triol, trimethylol ethane, trimethylol propane, 1,3,5-trimethylol benzene, and the like.

In the present invention, bisphenol A propylene oxide addition products such as, for example, polyoxypropylene-(6)-2,2-bis(4-hydroxyphenyl) propane, polyoxypropylene-(2.2)-2,2-bis(4-hydroxyphenyl) propane, polyoxypropylene-(2.4)-2,2-bis(4-hydroxyphenyl) propane, and polyoxypropylene-(3.3)-2,2-bis(4-hydroxyphenyl) propane, are referred to as polyoxypropylene-bis (4-hydroxyphenyl) propane.

Among the polyvalent alcohols having a valence of two or more which may be employed in the present invention are aromatic polyvalent alcohols and aliphatic polyvalent alcohols.

The polyvalent alcohols described above may be classified as given hereinbelow.

Among the aromatic polyvalent alcohols which may be employed in the present invention are the following three types of compounds.

(A) Examples of bisphenol A ethylene oxide addition products (in the present invention, these are referred to as polyoxyethylene-bis(4-hydroxyphenyl) propane), include polyoxyethylene-(2.2)-2,2-bis(4-hydroxyphenyl) propane, polyoxyethylene-(2.2)-polyoxyethylene-(2.0)-2,2-bis(4-hydroxyphenyl) propane, polyoxyethylene-(6)-2,2-bis(4-hydroxyphenyl) propane, polyoxyethylene-(2.2)-2,2-bis(4-hydroxyphenyl) propane, polyoxyethylene-(2.4)-2,2-bis(4-hydroxyphenyl) propane, polyoxyethylene-(3.3)-2,2-bis(4-hydroxyphenyl) propane, and derivatives thereof.

(B) Examples of bisphenol A propylene oxide addition products (referred to in the present invention as polyoxypropylene-bis(4-hydroxyphenyl) propane) include, for example, polyoxypropylene-(6)-2,2-bis(4-hydroxyphenyl) propane, polyoxypropylene-(2.2)-2,2-bis (4-hydroxyphenyl) propane, polyoxypropylene-(2.4)-2,2-bis(4-hydroxyphenyl) propane, polyoxypropylene-(3.3)-2,2-bis(4-hydroxyphenyl) propane, and derivatives thereof.

(C) Examples of the aromatic polyvalent alcohols having a valence of three or more include, for example, 1,3,5-trimethylol benzene.

Furthermore, among the aliphatic polyvalent alcohols, examples of aliphatic diols include, for example, 1,4-cyclohexane dimethanol, ethylene glycol, diethylene glycol, triethylene glycol, propylene glycol, dipropylene glycol, tripropylene glycol, butane diol, pentane diol, hexane diol, polyethylene glycol, polypropylene glycol, ethylene oxide-propylene oxide random copolymer diol, ethylene oxide-propylene oxide block copolymer diol, ethylene oxide-tetrahydrofuran copolymer diol, and polycaprolactone diol, and furthermore, examples of aliphatic polyvalent alcohols having a valence of three or more include, for example, sorbitol, 1,2,3,6-hexane tetraol, 1,4-sorbitan, pentaerythritol, 1,2,4-butane triol, 1,2,5-pentane triol, glycerin, 2-methyl propane triol, 2-methyl-1,2,4-butane triol, trimethylol ethane, trimethylol propane, and the like.

Two embodied modes employing the polyvalent alcohol having a valence of two or more of the present invention are given below.

(1) The Case in which an Aromatic Polyvalent Alcohol is Employed as a Chief Component By selecting, as the binder resin, a polyester resin employing, as a necessary component, as the polyvalent alcohol having a valence of 2 or more, a bisphenol A polyoxyalkylene oxide addition product such as, for example, polyoxyethylene-bis(4-hydroxyphenyl) propane or polyoxypropylene-bis(4-hydroxyphenyl) propane, it is possible to increase the mechanical strength of the toner. As a result, the toner is able to withstand the physical shear from agitation or the like within the developing apparatus during long term printing, and furthermore, a toner is attained which is capable of forming a toner layer which is tougher and stronger and more able to resist friction and bending after fixation.

If one contrasts a polyethylene resin obtained using polyoxyethylene-bis(4-hydroxyphenyl) propane as a chief component with a polyester resin which is obtained using polyoxypropylene-bis(4-hydroxyphenyl) propane as a chief component, the toner obtained using the latter has greater particle strength, and accordingly, it has better durability, resistance to abrasion, and bending properties.

When an aliphatic diol is concomitantly used in such a case, it is desirable that the proportion of aliphatic diol employed be 30 mole percent or less in comparison with the total alcohol component. An amount of 20 mole percent or less is more preferable.

(2) The Case in which an Aliphatic Polyvalent Alcohol is Employed as a Chief Component By employing an aliphatic polyvalent alcohol, the compatibility of the polyester resin with waxes is improved, and the anti-offset properties are improved. Furthermore, by making the polyester main chain flexible, the fixation properties at low temperatures are improved.

Furthermore, in such a case, it is preferable that an aromatic dicarboxylic acid and aliphatic diols having ether bonds to the main chain be employed as the combination of polyvalent carboxylic acid and polyvalent alcohol which is employed together with the epoxy compound having two or more epoxy groups. Examples of the aromatic dicarboxylic acid include, for example, phthalic anhydride, terephthalic acid, isophthalic acid, orthophthalic acid, and the like, and examples of the aliphatic diols having ether bonds to the main chain include, for example, diethylene glycol, triethylene glycol, dipropylene glycol, tripropylene glycol, polyethylene glycol, polypropylene glycol, ethylene oxide-propylene oxide random copolymer diol, ethylene oxide-propylene oxide block copolymer diol, ethylene oxide-tetrahydrofuran copolymer diol, polycaprolactone diol, and the like. The amount of aromatic dicarboxylic acid employed is preferably 60 or more mole percent of the total-acid component, and more preferably 70 mole percent or greater. The amount of aliphatic diols having ether bonds to the main chain is preferably within a range of 5–50 mole percent of the total alcohol component, and more preferably within a range of 10–40 mole percent thereof. By employing these combinations and these amounts, it is possible to improve the fixation properties at low temperatures, and the dispersability of wax is improved, so that the anti-offset properties are also improved.

When the aromatic diols described above are concomitantly employed in such a case, it is preferable that the proportion of aromatic diols be 30 mole percent or less with respect to the total alcohol component. A level of 20 mole percent or less is more preferable.

The polyester resin in the present invention may be obtained by conducting a dehydration condensation reaction or an ester exchange reaction using the raw material components (1) (2) and (3) described above, for example in the presence of a catalyst. The reaction temperature and reaction period are not particularly restricted; however, these are normally within a range of 150–300° C. and 2–24 hours.

Examples of the catalyst which may be employed when conducting the reaction described above include, for example, zinc oxide, tin (I) oxide, dibutyl tin oxide, dibutyl tin dilaurate, paratoluene sulfonic acid, and the like. Tetrabutyl titanate may also be used.

Whereas conventional polyester resins for use in electrostatic image developing toners employed epoxy compounds having a valence within a range of 2–4, the present invention employs epoxy compounds having a valence of 5 or more, so that superior toner properties are realized.

It is possible to produce the polyester resin of the present invention by means of the processes of types one and two described below.

[Type 1]; components (1), (2), and (3) are mixed together in a batch and caused to react (batch reaction).

[Type 2]; after (1) and (2) are allowed to react, (3) is allowed to react, or alternatively, after (1) and (3) are allowed to react, (2) is allowed to react (two step reaction).

An example of a conventional method is the method given below.

[Type 3]; after producing a polyester main chain by means of the reaction of (2) and (3), (1) is allowed to react (two stage reaction).

The differences in terms of chemical structure or the differences in effect when employed as a toner between the resin obtained by means of the type 1 method or type 2 method adopted in the present invention and the resin produced by the conventional method will be explained hereinbelow.

The skeleton of the resins produced by means of the three types of reactions differs slightly. In type 1 and type 2, the epoxy compound which is the crosslinking agent reacts with the carboxylic acid monomers and or the alcohol monomers, and thereafter, the chain lengthening reaction occurs. Accordingly, in such a case, there are cases in which, prior to the occurrence of the chain lengthening reaction, a single molecule of carboxylic acid or alcohol monomer reacts with a number of epoxy compound molecules corresponding to the valence number of the monomer, in other words, with two or more epoxy crosslinking agents. In the case of the terminus, by allowing such a reaction to occur in a continuous chain manner, areas are produced in which the epoxy crosslinking agent is present at an extremely high density.

In particular, in the epoxy compound employed in the present invention, by reacting a single epoxy group with a carboxylic acid group or a hydroxyl group, a secondary hydroxyl group is produced, and this hydroxyl group further reacts with another carboxyl group. In other words, one carboxyl group functions as two valence groups, so that in the type one and type two reactions, the polyester resin exhibits a crosslinking structure which has an extremely high density.

On the other hand, the fact that areas are produced in which the crosslinking agent is concentrated means that areas are produced in the following main chain-lengthening reaction in which the crosslinking density is low. In other words, in type 1 and type 2, areas of high crosslinking density and areas of low crosslinking density are produced in the resin, so that variations are produced in the crosslinking density.

Low molecular weight components of the binder resin melt and penetrate into the paper, or fuse to adjacent toner particles, and thereby the toner is fixed. Furthermore, the high molecular weight components of the binder resin maintain their elasticity even during periods of high temperature, and prevent offset onto the fixing roller. Accordingly, the fact that variations in crosslinking density are present in the binder resin means that an extremely wide distribution of molecular weight is created, and thus superior fixation properties and anti-offset properties can be obtained in a broader range of temperatures. Furthermore, toner having high crosslinking density components possesses mechanical strength sufficient to withstand abrasion with the carrier in the developing apparatus.

On the other hand, in the type 3 reaction, the carboxylic acid and the alcohol are first reacted, and once the main chain has been formed, the epoxy crosslinking agent is reacted. In such a case, the epoxy compounds react at both terminuses of the polyester main chain, so that the likelihood of a structure in -which the epoxy crosslinking agent is extremely concentrated, as in type 1 or type 2 reactions, is extremely low.

In the present invention, the use of an epoxy compound with a valence of 5 or more is required, so that even using this method, a considerable crosslinking density is obtained, and the molecular weight distribution is broad; however, it is not as great as that of type 1 or type 2.

For the foregoing reasons, it is preferable that type 1 and type 2 methods be employed during the formation of the polyester resin of the present invention. Furthermore, from the point of view of a shortening and simplification of the manufacturing process, the type 1 reaction method is preferably employed.

Furthermore, with respect to the polyester resin of the present invention, by means of employing an unsaturated dibasic acid as a portion or the entirety of component (2) described above, it is possible to produce a crosslinked polyester having a structure in which both crosslinking by means of epoxy compounds and crosslinking by means of the unsaturated dibasic acid occur. In such a case, commonly, in order that the unsaturated double bonds of the unsaturated dibasic acid not be broken, a method is employed in which a precursor polyester resin containing molecule-internal double bonds is produced, and then these molecule-internal double bonds are broken to create polymerization and crosslinking.

Examples of the unsaturated basic acid include, for example, maleic acid, maleic anhydride, fumaric acid, itaconic acid, mesaconic acid, citraconic acid, and the like.

The crosslinking reaction by means of the unsaturated dibasic acid is conducted by first producing a polyester main chain in the standard manner, and then using heat or a polymerization initiator. When heating is employed, the temperature is within a range of 230–260° C., and the reaction is conducted for a period within a range of approximately 3–15 hours, while in the presence of a polymerization initiator, the temperature is within a range of 130–250° C., and the reaction is conducted for a period of approximately 0.5–15 hours.

Examples of the polymerization initiator described above include, for example, tert-butyl hydroperoxide, cumene hydroperoxide. ditert-butyl peroxide, tert-butyl peroxybenzoate, dicumyl peroxide, tert-butyl cumyl peroxide, and the like. The amount of this polymerization initiator is within a range of 0.01–5 percent by weight of the polyester resin, and preferably within a range of 0.02–2 percent by weight.

It is preferable that the glass transition temperature (Tg) of the polyester resin employed in the present invention be 55° C. or more, and among these temperatures, it is particularly preferable that Tg be within a range of 55–85° C. When Tg is less than 55° C., it is likely that, in cases of exposure to high temperature during storage, conveyance, or in the interior of the developing apparatus, the blocking phenomenon (heat cohesion) will occur.

Furthermore, it is preferable that the ratio ($M_w/M_n$) of the weight average molecular weight ($M_w$) and the numerical average molecular weight ($M_n$) as measured by GPC in the polyester resin of the present invention be 10 or more, and that the ratio ($I_{10}/I_{01}$) of the relative strength ($I_{10}$) at the position corresponding to a molecular weight of 100,000 as measured by GPC and the relative strength ($I_{01}$) at the position corresponding to a molecular weight corresponding to 10,000 be within a range of 0.1–0.4.

Among them, the resin having a ratio ($M_w/M_n$) of 15 to 60 and the resin having a ratio ($M_w/M_n$) of 10 or more, preferably 15 to 60, and a ratio ($I_{10}/I_{01}$) of 0.1 to 0.4 are most preferred.

The molecular weight of the resin in the present invention is a value in which the component dissolved by tetrahydrofuran is measured by means of GPC.

When $M_w/M_n$ is less than 10, or ($I_{10}/I_{01}$) is less than 0.1, then the anti-offset characteristics worsen at high temperatures, while when ($I_{10}/I_{01}$) is in excess of 0.4, then the fixation properties at low temperature are poor.

As a further preferable embodied mode, it is further preferable from the point of a balance between low temperature fixation properties and anti-offset properties that the polyester resin have a ratio, ($M_w/M_n$) between the weight average molecular weight ($M_w$) and the numerical average molecular weight ($M_n$), as measured by gel permeation chromatography (GPC), of 10 or more, that the ratio ($I_{10}/I_{01}$) between the relative strength ($I_{10}$) at a position corresponding to a molecular weight of 100,000 as measured by gel permeation chromatography (GPC) and the relative strength ($I_{01}$) at a position corresponding to a molecular weight of 10,000 be within a range of 0.1–0.4, and furthermore, that the ratio ($I_{100}/I_{01}$) between the relative strength ($I_{100}$) at a position corresponding to a molecular weight of 1,000,000 and the relative strength ($I_{01}$) at a position corresponding to a molecular weight of 10,000 be within a range of 0.05–0.3.

When this value ($I_{100}/I_{01}$) is less than 0.05, the anti-offset properties are poor, while when the value is in excess of 0.3, the low temperature fixation properties are poor.

In the present invention, all the molecular weights of the polyester resin are polystyrene conversion molecular weights.

In the present invention, the weight average molecular weight ($M_w$), the numerical average molecular weight ($M_n$), and the relative strengths ($I_{10}$, $I_{01}$) at positions corresponding to polystyrene molecular weights are measured in accordance with the measurement condition shown hereinbelow.

GPC apparatus: HLC-8120 GPC, produced by Toso K.K.

COLUMN: TSK-GEL GE5000 HXL, G-4000 HXL, G-3000 HXL, and G-2000 HXL produced by Toso K.K.

Solvent: tetrahydrofuran

Solvent concentration: 0.5% by weight

Flow rate: 1.0 ml/min

* The molecular weight of resins containing gel components not soluble in tetrahydrofuran was measured after filtration using a membrane filter.

Furthermore, the softening point of the polyester resin employed in the present invention is 90° C. or greater, and among these temperatures, a range 90° C.–180° C. is preferable, and a range of 100° C.–150° C. is more preferable. When the softening point is less than 90° C., the toner tends to cohere, and this causes trouble during storage or printing, while when the softening point is in excess of 180° C., the fixation properties often become poor. It is preferable that the binder resin employed in the present invention have a Tg within a range of 55–85° C. and a softening point within a range of 90°–180° C.

In order that the moisture resistance of the toner be good, it is preferable that the acid value of the polyester resin of the present invention be 20 mgKOH/g or less.

Conventional colorants may be employed in the present invention. Examples of black colorants include carbon blacks which are differentiated based on their method of preparation, such as furnace black, channel black, acetylene black, thermal black, lamp black, and the like; examples of blue colorant include the phthalocyanine C.I. Pigment Blue 15-3, and the indanthrone C.I. Pigment Blue 60 and the like; examples of red colorants include the quinacridone C.I. Pigment Red 122, the azo C.I. Pigment Red 22, C.I. Pigment Red 48:1, C.I. Pigment Red 48:3, C.I. Pigment Red 57:1, and the like; yellow colorants include the azo C.I. Pigment Yellow 12, C.I. Pigment Yellow 13, C.I. Pigment Yellow 14, C.I. Pigment Yellow 17, C.I. Pigment Yellow 97, C.I. Pigment Yellow 155, the isoindolinone C.I. Pigment Yellow 110, the benzimidazolone C.I. Pigment Yellow 151, C.I. Pigment Yellow 154, C.I. Pigment Yellow 180, and the like. The amount of colorant contained is within a range of one part per weight to 20 parts per weight with respect to 100 parts per weight of the binder resin. One type of such colorant may be employed, or two or more may be employed in combination.

Among charge control agents which may be employed in the present invention, examples of positive charge control agents include nigrosine dyes, triphenyl methane dyes, quaternary ammonium salts, and resins containing quaternary ammonium groups and/or amino groups, while examples of negative charge control agents include, for example, trimethyl ethane dyes, mixed metal salts of salicylic acid, mixed metal salts of benzylic acid, copper phthalocyanine, perylene, quinacridone, azo pigments, mixed metal salt azo pigments, organic pigments containing heavy metals such as azo chromium complex, phenol condensation products of the calixarene type, ring type polysaccharides, and the like. It is desirable that a positive charge control agent be included in the colored resin particles of the present invention. It is desirable that these charge control agents be used in an amount of within a range of 0.5–5 parts by weight per 100 parts per weight of the binder resin.

Among the compounds described above, when a positive charge type toner is employed, the use of a nigrosine dye or a quaternary ammonium salt as the positive charge type charge control agent is preferable, and the use of both together is particularly preferable. It is preferable that at least one compound selected from the compounds (1) and (2) having the structure shown below be employed as the quaternary ammonium salt compound. An example of the compounds having the structure shown in (1) is Bontrone P-51 (produced by Orient Chemical), while examples of the compound of (2) are TP-302, TP-415, and TP-610 (produced by Hodogaya Chemical).

Furthermore, although the structure thereof is not completely clear, copy charge PSY (produced by Clariant Japan) may also be employed in an advantageous manner as the quaternary ammonium salt positive charge control agent.

compound (1)

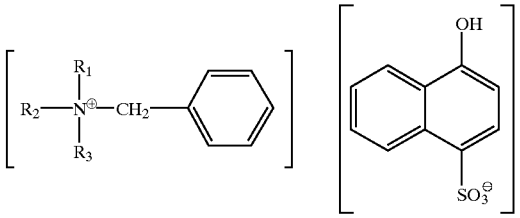

(In the formula, $R_1$–$R_3$ indicate $C_nH_{2n+1}$ groups. Here, n is an integer within a range of 1–10. Furthermore, $R_1$–$R_3$ need not be the same, and may differ).

compound (2)

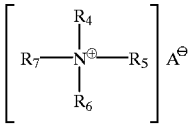

(In the formula, $R_4$, $R_5$, $R_6$, and $R_7$ represent respectively and independently, a hydrogen atom, an alkyl group or alkenyl group having a number of carbons within a range of 1–22, an unsubstituted or substituted aromatic group having a number of carbons within a range of 1–20, and an aralkyl group having a number of carbons within a range of 7–20, $A^-$ indicates a molybdic acid anion or a tungstic acid anion, or a heteropolyacid anion containing molybdenum or tungsten atoms).

In greater detail, the following compounds may be employed (1-1)

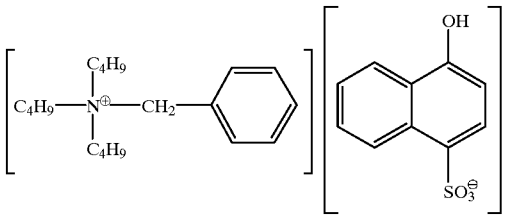

(2-1)

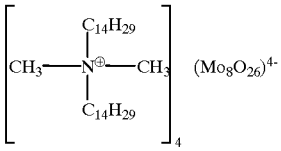

(2-2)

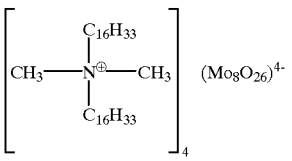

-continued (2-3)

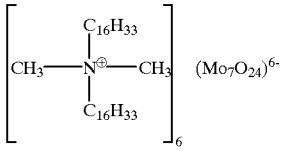

(2-4)

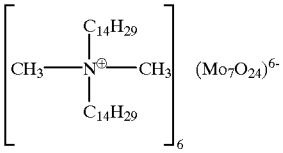

(2-5)

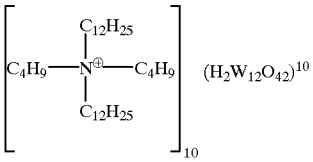

(2-6)

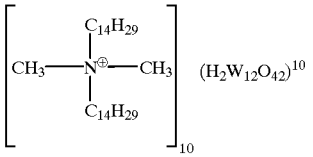

(2-7)

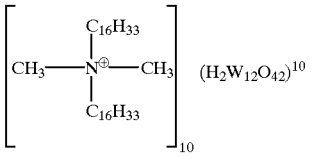

(2-8)

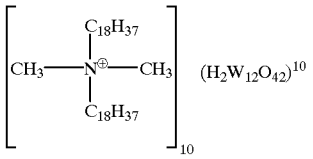

(2-9)

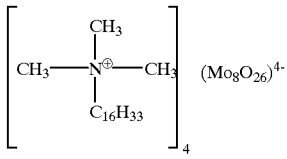

(2-10)

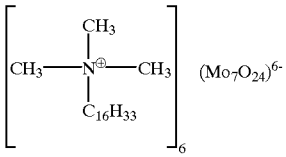

-continued (2-11)

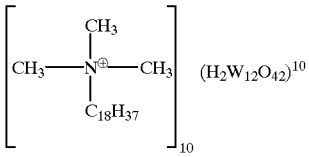

It is preferable, when the nigrosine dye and the quaternary ammonium salt compound are used together, that the proportions in which they are used be within a range of 1/9–9/1 (weight ratio), and a weight ratio of 2/8–8/2 (weight ratio) is more preferable. Nigrosine dyes generally have a strong ability to apply a positive charge; however, the uniformity and stability of the charge are poor, and when used alone, fogging is likely to occur, and the printed image often lacks sharpness. On the other hand, the quaternary ammonium salt compounds have a weak ability to provide a positive charge, so that it is difficult to obtain an amount of charge over a specified period, However, by using both together, uniformity and stability of the charge are obtained, and it is possible to stably obtain a clear printed image which does not exhibit fogging during continuous printing. When the proportion of nigrosine dye employed is lower than 1, it is difficult to achieve sufficient charge in the toner, and the sticky portions are non-uniform, so that a low quality image in which the outlines of the image are unclear is likely to result. Furthermore, when the proportion employed is greater than 9, the amount of charge becomes excessive, and a developer results which exhibits unstable charge behavior. In this way, when either too much or too little is present, the desired amount of charge cannot be obtained, and as a result, printing exhibiting low density and low quality results and the developer exhibits a large amount of toner dispersion. By means of appropriately setting the proportions of the agents, it is possible to obtain the optimal amount of charge, and thus a developer is obtained which exhibits no toner dispersion and has a long useful life and allows high density and high quality printing in which there is no fogging and in which the outlines of the image are clear.

It is preferable that 0.3–10 parts per weight of the positive charge control agent be employed per 100 parts per weight of the binder resin, and this amount is more preferably within a range of 1–5 parts per weight.

The colored resin particles in the present invention function as a toner, and have as chief components thereof the binder resin comprising the polyester resin as described above, a colorant, and a charge control agent; however, other additives may also be included in the colored resin particles.

For example, metallic soaps, zinc stearate, or the like may be employed as the lubricant, and cerium oxide, silicon carbide, or the like may be employed as an abrasive.

Furthermore, in the case in which a portion or all of the colorant is replaced by a magnetic powder, it is possible to employ this as a magnetic single component developing toner. Examples of the magnetic powder include ferromagnetic metals such as iron, cobalt, nickel, or the like, or powders of alloys or compounds of magnetite, hematite, ferrite, and the like. Powders are also preferably employed in which such a magnetic powder is subjected, where necessary, to a hydrophobic treatment with organic silicon or titanium compounds or the like. The amount of magnetic powder included is preferably within a range of 15–70 weight percent with respect to the toner weight.

Furthermore, in heat roller fixation uses, in order to prevent trouble arising from the deposition of toner onto and contamination of the heat roller (offset) where necessary, various waxes may be employed as adjuvants which increase the releasing effects; examples thereof which may be employed include, for example, natural waxes such as montanic acid ester wax, polyolefin waxes such as high pressure method polyethylene and polypropylene, polyamide waxes, Fischer-Tropsch wax, synthetic ester wax, and the like.

Among the above, the following are particularly preferably employed in the present invention: carnauba wax, montan ester wax, rice wax and/or wax from scale insects. These waxes exhibit the best dispersability in the polyester resin having a structure of the present invention, and allow for dramatic improvements in fixation properties and anti-offset properties.

It is preferable that the carnauba wax which is employed be carnauba wax from which free aliphatic acids have been removed by refining. It is preferable that the acid number of this carnauba wax from which free aliphatic acids have been removed be eight or less, and more preferably the acid number is five or less. The carnauba wax from which free aliphatic acids have been removed more readily forms microcrystals than conventional carnauba wax, and this increases its dispersability in the polyester resin. The montan ester wax is refined from minerals, and as a result of the refining, forms microcrystals in the same way as carnauba wax, thus increasing its dispersability in the polyester resin. It is preferable that the acid number of this montan ester wax be 30 or less. Furthermore, the rice wax is refined from rice husk wax, and the acid number thereof is preferably 13 or less. The scale insect wax may be obtained by dissolving the wax from components secreted by young scale insects (also termed Chinese wax insects) in, for example, hot water, and removing the supernatant and then cooling and solidifying, or by repeating this process. The scale insect wax refined in this manner is white in color when in a solid state, exhibits an extremely sharp melting point, and may be used as the wax for the toner in the present invention. When refined, the acid number thereof is 10 or less, and a value of 5 or less is preferable for use as the toner.

The waxes described above may be used singly or may be used in combination, and by including an amount within a range of 0.3–15 parts per weight with respect to the binder resin, and preferably within a range of 1–5 parts per weight, it is possible to achieve satisfactory fixation and offset properties. When the amount is less than 0.3 parts per weight, the anti-offset properties are poor, while when the amount is in excess of 15 parts per weight, the fluidity of the toner is poor, and furthermore, spent carrier occurs as a result of deposition on the surface of the carrier, and this has an adverse effect on the charge characteristics of the toner.

Furthermore, in addition to the natural waxes described above, synthetic ester waxes may also be advantageously employed. Among these synthetic ester waxes are Elctol WPE-5 (produced by Nippon Oil and Fat Inc.), and the like. Furthermore, it is also possible to simultaneously employ synthetic waxes such as polypropylene wax, polyethylene wax, and the like.

The toner of the present invention may be obtained by extremely common manufacturing methods, and does not require special manufacturing methods; however, it is possible to obtain this toner by first melting and kneading the resin, the colorant, and the charge control agent at a temperature above the melting point of the resin (the softening point), and pulverizing and classifying this.

Concretely, for example, using the resin described above, the colorant, and the charge control agent as required components, the mixing may be accomplished by means of a kneading process using two rollers, three rollers, a pressure kneader, or a two-axle extrusion machine or the like. At this time, it is sufficient if the colorant and the like are uniformly dispersed in the resin, so that the melting and kneading conditions are not particularly restricted; however, these are commonly within a range of 80–180° C. and from 30 seconds to 2 hours. A flushing procedure may be carried out in advance so that the colorant is uniformly dispersed in the resin, or alternatively, this may be mixed and kneaded at high concentrations with the resin in a master batch.

Next, after conducting cooling, this is pulverized in a pulverizer such as a jet mill or the like, and separated by means of an air separator or the like.

The average particle diameter of the particles-which form the base material of the toner is not particularly restricted; however, this is normally set within a range of 5–15 micrometers.

Commonly, particles having a diameter smaller than that of the toner base material (commonly termed external additives) are mixed with the toner base material obtained in this material using a mixing machine such as, for example, a Henschell mixer.

The external additives employed in the present invention are not necessarily limited with respect to materials or types insofar as they may be employed in order to improve the surface of the toner base material, such as, for example, an increase in the fluidity of the toner, and improvement in the charge characteristics thereof, or the like; however, possible materials employed include, for example, inorganic microparticles such as silicon dioxide, titanium oxide, aluminum oxide, cerium oxide, zinc oxide, tin oxide, zirconium oxide, and the like, as well as the products resulting when these are subjected to surface treatment using a hydrophobic treating agent such as silicon oil, a silane coupling agent, or the like, as well as resin microparticles of, for example, polystyrene, acrylic, styrene acrylic, polyester, polyolefin, cellulose, polyurethane, benzoguanamine, melamine, nylon, silicone, phenol, vinylidene fluoride, Teflon, or the like.

The particle diameter of the external additives is preferably one-third or less that of the diameter of the colored particles which comprise the base material toner, and more preferably one-tenth that diameter or less.

Furthermore, these external additives such as silica or the like may be simultaneously employed in two types having differing average particle diameters. Furthermore, the proportion thereof which is employed is normally within a range of 0.05–5 percent by weight with respect to 100 parts per weight of the toner base material, and is preferably within a range of 0.1–3 percent by weight.

Among these, silicon dioxide (silica), the surface of which has been subjected to hydrophobic treatment by means of various polyorganosiloxanes or silane coupling agents, is particularly advantageously employed. Such a product is commercially available under, for example, the following trade names Aerosil R972, R974, R202, R805, R812, RX200, RY200, R809, RX50, RA200HS, RA200H (Nippon Aerosil)

Wacker HDK K2000, H2050EP HDK H3050EP, HVK2150 (Wacker Chemicals East Asia)

Nipsil SS-10, SS-15, SS-20, SS-50, SS-60, SS-100, SS-50B, SS-50F, SS-1OF, SS-40, SS-70, SS-72F (Nippon Silica Industries)

Cabosil TG820F (Cabot Specialty Chemicals Inc.)

The electrostatic image developer in the present invention comprises a toner composition containing colored resin particles and a magnetic carrier. It is preferable that the surfaces of the magnetic carrier be coated with resin. By coating these surfaces with resin, the charge of the developer is stabilized.

The carrier employed in the present invention may be the iron powder carrier which is commonly employed in the two component developing method, a magnetite carrier, or a ferrite carrier; among these, ferrite or magnetite carriers, which have a low true specific gravity, a high resistance, which have superior environmental stability, and are easy to make spherical and thus have good flow characteristics, are preferably employed. The shape of the carrier may be spherical or unspecified. The average particle diameter is generally within a range of 10–500 microns; however, in printing high-resolution images, a range of 30–80 microns is preferable.

Furthermore, a coated carrier in which such a carrier is covered with resin may be employed, and examples of the coating resin include, -for example, polyethylene, polypropylene, polystyrene, polyacrylonitrile, polyvinyl acetate, polyvinyl alcohol, polyvinyl butyral, polyvinyl chloride, polyvinyl carbazole, polyvinyl ether polyvinylketone, vinyl chloride-vinyl acetate copolymer, styrene/acrylic copolymer, straight silicon resin comprising organosiloxane bonds or derivatives thereof, fluorine resin, (meth) acrylate resin, polyester, polyurethane, polycarbonate, phenol resin, amino resin, melamine resin, benzoguanamine resin, urea resin, amide resin, epoxy resin and the like. Among these, silicon resin, fluorine resin, and (meth) acrylate resin have superior charge stability and coating strength and are preferably employed. In other words, in the present invention, it is preferable that the magnetic carrier be a resin coated magnetic carrier coated with one or more resins selected from a group consisting of silicon resin, fluorine resin, and (meth) acrylate resin.

The method of coating the resin onto the surface of the core material of the carrier is not particularly restricted; however, examples thereof include an impregnation method in which impregnation occurs in a solution of the coating resin, a spray method in which the coating resin solution is sprayed onto the surface of the core material of the carrier, a fluidized bed method in which spraying is conducted while the carrier is entrained in moving air, or a kneader coating method in which the carrier core material and the resin coating solution are mixed in a kneader coater, and solvent is removed.

No particular restriction is made with respect to the solvent which is employed in the coating resin solution, insofar as it is capable of dissolving the coating resin; however, solvents which may be employed include, for example, toluene, xylene, acetone, methyl ethyl ketone, tetrahydrofuran, dioxane, and -the like. The thickness of the coating layer on the surface of the carrier is normally within a range of 0.1–3.0 microns.

No particular restriction is made with respect to the proportion by weight of the toner containing colored resin particles and the magnetic carrier. However, normally, with respect to 100 parts per weight of carrier, 0.5–10 parts per weight of toner are employed.

The electrostatic image developer toner composition and developer of the present invention which are obtained in this manner may be used in development and fixation on recording media by means of methods commonly known in the art; however, it is preferable that the heat roller fixation method be adopted.

The heating roller which is employed is preferably one in which the cylindrical surface which is capable of being heated to a temperature which is capable of melting and fixing the toner is coated with a coating resin which combines releasing properties and resistance to heat, such as, for example, silicon resin or fluorine resin.

In the heat roller fixing method, the fixation of the toner is conducted by passing the recording medium between two rollers while applying an appropriate amount of pressure to at least one heat roller described above.

The individual dramatic technological effects of the electrostatic image developing toner composition of the present composition of the present invention are exhibited in developing and fixing apparatuses which conduct development and heat roller fixation at high speed.

In high speed developing and fixation apparatuses., the agitation speed of the developer becomes extremely high within the developing apparatus and corresponding shear is created between the toner and the carrier. Furthermore, after development, the recording medium passes through the fixation apparatus in a shorter period of time, so that in order to achieve a stronger toner fixation image, it is necessary to set the pressure between the fixation rollers to a higher level. At this time, the toner melts in a short period of time and reaches a viscosity at which it may be fixed, while maintaining an appropriate degree of elasticity so as to prevent the occurrence of the offset phenomenon. Furthermore, as a result of the increase in the printing speed, the toner images fixed on the recording media rub against each other or against the conveying members within the machine, and there must be resistance to this abrasion. The toner composition for electrostatic image development of the present invention has sufficient mechanical strength, elasticity, and resistance to abrasion, so that it is optimal for use under the conditions described above; that is to say, it is optimal for use in apparatuses which conduct development and fixation at high speeds.

No particular restrictions are made with respect to the speed of the heat roller fixation of the toner composition for electrostatic image development of the present invention; however, this is within a range of 200–20 meters per minute, and preferably within a range of 180–30 meters per minute. Within this range, the superiority of the electrostatic image developer is even clearer. The preferable fixation speed described above corresponds to 600–100 sheets per minute when converted to printing speed onto A-4 size paper.

Any of the conventional recording media may be employed in the present invention; for example, examples thereof include papers such as standard paper or resin coated paper or the like, or synthetic resin films or sheets such as PET film, OHP sheets, or the like.

EXAMPLES

Hereinbelow, the present invention will be further explained in detail using embodiments and comparative examples. Hereinbelow, the numerical values within the composition descriptions indicate parts per weight. First, an example of the synthesis of the binder resin which is employed in the preparation of the toner will be given.

Resin Synthesis Example 1

527 grams of polyoxypropylene (2,2)-2,2-bis(4-hydroxyphenyl) propane, 283 grams of tetephthalic acid, 53 grams of Epiclon N-695 (produced by Dainippon Ink and Chemicals, Inc.: a polyfunctional cresol novolak type epoxy resin having a distribution in the number of epoxy groups per molecule, wherein the number of epoxy groups per molecule is two or more, and wherein the average thereof is five-or-more), 20 grams of trimellitic anhydride and 2.5 grams of tetrabutyl titanate were placed in a glass 2-liter four-mouthed flask, and a thermometer, a stir bar, and a nitrogen input tube were attached, and this was heated for a period of 15 hours at a temperature of 240° C. under a constant nitrogen gas flow in an electric mantle heater, and subsequently, depressurization was conducted and the reaction was continued at a pressure of 10 mmHg. The reaction was followed using the softening point in accordance with the ASTM-E28-517 standard, and the reaction was brought to a halt when the softening point reached 132° C.

The polymer obtained was a colorless solid, and had an acid number of 4 KOHmg/g, a glass transition temperature as measured by the DSC method of 63° C., and a softening temperature of 138° C.

Resin Synthesis Example 2

A synthesis was conducted which was identical to that of synthesis example 1, with the exception that the amount of terephthalic acid was 301 grams, the amount of Epiclon N-695 was 75 grams, and no trimellitic anhydride was employed; as a result, a colorless resin was obtained which had an acid number of 3 KOHmg/g, a glass transition temperature as measured by the DSC method of 65° C., and a softening point of 138° C.

Resin Synthesis Example 3

A synthesis was conducted which was identical to that of synthesis example 1, with the exception that the Epiclon N-695 was replaced by 48 grams of Epiclon N-775 (produced by Dainippon Ink and Chemical, Inc.: a polyfunctional cresol novolak type epoxy resin having two or more epoxy groups per molecule, including a cresol novolak type epoxy resin with five functional groups having five epoxy groups per molecule); as a result, a colorless resin was obtained which had an acid number of 5 KOHmg/g, a glass transition temperature as measured by the DSC method of 62° C., and a softening point of 136° C.

Resin Synthesis Example 4

301 grams of terephthalic acid, 75 grams of Epiclon N-695, and 2.5 grams of tetrabutyl titanate were placed in a glass 2-liter four-mouthed flask, and a thermometer, a stir bar, and a nitrogen introduction tube were attached thereto, and this was heated for a period of five hours at a temperature of 240° C. under a constant nitrogen gas flow in an electric mantle heater, and subsequently, 527 grams of polyoxypropylene (2,2)-2,2-bis (4-hydroxyphenyl) propane was added, and this was reacted for a further ten hours. After this, depressurization was conducted, and the reaction was continued at 10 mmHg. The reaction was followed in accordance with the softening point stipulated in ASTM.E28-517, and the reaction was brought to a halt when the softening point reached 134° C.

The polymer obtained was a colorless solid, and had an acid number of 4 KOHmg/g, a glass transition temperature of 64° C. as measured by the DSC method, and a softening point of 137° C.

Resin Synthesis Example 5

920 parts per weight of polyoxypropylene (2,2)-2,2-bis (4-hydroxyphenyl) propane, 20 parts per weight of Epiclon N-695, 300 parts per weight of terephthalic acid, 35 parts per weight of maleic anhydride, and 1.5 parts per weight of dibutyl tin oxide were placed in a glass 2-liter four-mouthed flask, and the temperature was slowly raised under a flow of nitrogen gas, and reaction was carried out for 10 hours at a temperature of 240° C. This polyester resin had an acid number of 10.

Furthermore, this resin was lowered in temperature to 180° C., five parts per weight of ditert-butyl peroxide were added and this was agitated for 30 minutes, the temperature was raised to 240° C., agitation was conducted for a period of 3 hours, and further polymerization was allowed to take place to produce the resin for use in the toner. The resin obtained was a solid at room temperature and had an acid number of 7.5, a glass transition temperature as measured by the DSC method of 62° C., and a softening point of 138° C. (ring and ball method).

By means of steps identical to those of resin synthesis example 1, resin synthesis examples 6 and 7 were prepared with the compositions shown in Table 1.

Furthermore, the synthesis of a conventional resin shown below was conducted.

Resin Synthesis Example 8

Resin Synthesis Example 1 for Comparative Examples 527 grams of polyoxypropylene (2,2)-2,2-bis(4-hydroxyphenyl) propane, 301 grams of terephthalic acid, and 2.5 grams of tetrabutyl titanate were placed in a glass 2-liter four-mouthed flask, a thermometer, stir bar, and nitrogen introduction tube were attached thereto, and a reaction was carried out for a period of 10 hours at a temperature of 240° C. under a constant flow of nitrogen gas in an electric mantle heater, and subsequently, 75 grams of Epiclon N-695 were added, and a reaction was further carried out for 5 hours. After this, depressurization was conducted, and the reaction was continued at 10 mmHg. The reaction was followed in accordance with the softening point stipulated in ASTM-E28-517, and the reaction was halted when the softening point reached 133° C.

The polymer obtained was a colorless solid, and had an acid number of 6 KOHmg/g, a glass transition temperature as measured by the DSC method of 63° C., and a softening point of 136° C.

Resin Synthesis Example 9

Resin Synthesis Example 2 for Conventional Examples

A synthesis was conducted which was identical to that of synthesis example 1, with the exception that Epiclon N-695 was not employed, and the amount of trimellitic anhydride was set to 45 grams, and as a result, a colorless-resin was obtained which had an acid number of 5 KOHmg/g, a glass transition temperature as measured by the DSC method of 63° C., and a softening point of 135° C.

Furthermore, as a resin synthesis example 10 (resin synthesis example 3 for comparative examples), the synthesis of the preparation shown in synthesis example 10 in table 1 was conducted by following the procedures of resin synthesis example 1.

Hereinbelow, a table giving an overview of the resin synthesis examples is shown.

TABLE 1

Overview of the Synthesis Examples

| Synthesis Example | (1) Epoxy Compound | (2) Alcohol Component | (3) Acid Component | Acid Number | Tg | Softening Point | Reaction |
|---|---|---|---|---|---|---|---|
| 1 | Epiclon N-695 53 parts per weight | BPA(2,2)PO 527 parts per weight | TPA 283 parts per weight, TMA 20 parts per weight | 4 | 63° C. | 138° C. | Type 1 |
| 2 | Epiclon N-695 75 parts per weight | BPA(2,2)PO 527 parts per weight | TPA 301 parts per weight | 3 | 65° C. | 138° C. | Type 1 |
| 3 | Epiclon N-775 48 parts per weight | BPA(2,2)PO 527 parts per weight | TPA 283 parts per weight, TMA 20 parts per weight | 5 | 62° C. | 136° C. | Type 1 |
| 4 | Epiclon N-695 75 parts per weight | BPA(2,2)PO 527 parts per weight | TPA 301 parts per weight | 4 | 64° C. | 137° C. | Type 2 |
| 5 | Epiclon N-695 20 parts per weight | BPA(2,2)PO 920 parts per weight | TPA 300 parts per weight, MA 35 parts per weight | 7.5 | 62° C. | 138° C. | Type 1 |
| 6 | Epiclon N-695 7 parts per weight | DEG 21 parts per weight, NPG 104 parts per weight, EG 50 parts per weight | TPA 315 parts per weight | 3 | 62° C. | 140° C. | Type 1 |
| 7 | Cardura E 25 parts per weight, Epiclon N-695 7 parts per weight | DEG 53 parts per weight, NPG 104 parts per weight, PG 53 parts per weight | TPA 158 parts per weight, IPA 158 parts per weight | 6 | 62° C. | 142° C. | Type 1 |
| 8 | Epiclon N-695 75 parts per weight | BPA(2,2)PO 527 parts per weight | TPA 301 parts per weight | 6 | 63° C. | 136° C. | Type 3 |
| 9 | None | BPA(2,2)PO 527 parts per weight | TPA 283 parts per weight, TMA 45 parts per weight | 5 | 63° C. | 135° C. | — |

TABLE 1-continued

Overview of the Synthesis Examples

| Synthesis Example | (1) Epoxy Compound | (2) Alcohol Component | (3) Acid Component | Acid Number | Tg | Softening Point | Reaction |
|---|---|---|---|---|---|---|---|
| 10 | None | DEG 21 parts per weight, NPG 177 parts per weight, TMP 13 parts per weight | TPA 315 parts per weight | 4 | 61° C. | 141° C. | — |

The designations shown in the table are explained below.

BPA(2,2)PO: bisphenol A propylene oxide 2,2 mole addition product

TPA: terephthalic acid

TMA: trimellitlc anhydride

MA: maleic anhydride

IPA: isophthalic acid

Epiclon N-695: a polyfunctional type cresol novolak epoxy resin (epoxy equivalent: 220) produced by Dainippon Ink and Chemicals, Inc.

Epiclon N-775: a polyfunctional type phenol novolak epoxy resin (epoxy equivalent: 190) produced by Dainippon Ink and Chemical, Inc.

Cardura E: produced by Shell Japan

*neodecanic acid glycidyl ester

DEG: diethylene glycol

NPG: neopentyl glycol

EG: ethylene glycol

TMP: trimethylol propane

Reaction: Type 1-components (1), (2), and (3) are simultaneously reacted (batch reaction).

Type 2—components (1) and (2) are first reacted, and then component (3) is reacted, or alternatively components (1) and (3) are reacted, and then component (2) is reacted (two stage reaction).

Type 3—a polyester main chain is produced by means of the reaction of (2) and (3), and then component (1) is reacted (two stage reaction).

The GPC measurement results of the synthesis examples are shown in Table 2.

TABLE 2

GPC Measurement Results of the Synthesis Examples

| Synthesis Example | $M_w$ | $M_n$ | $M_w/M_n$ | $I_{10}/I_{01}$ | $I_{100}/I_{01}$ |
|---|---|---|---|---|---|
| 1 | 228500 | 3250 | 70.3 | 0.18 | 0.10 |
| 2 | 233500 | 2900 | 80.5 | 0.12 | 0.10 |
| 3 | 217800 | 3130 | 69.6 | 0.18 | 0.10 |
| 4 | 234000 | 2950 | 79.3 | 0.12 | 0.10 |
| 5 | 202300 | 3300 | 61.3 | 0.23 | 0.09 |
| 6 | 220800 | 3800 | 58.1 | 0.13 | 0.13 |
| 7 | 212000 | 3400 | 62.4 | 0.18 | 0.11 |
| 8 | 49300 | 5300 | 9.3 | 0.08 | 0.01 |
| 9 | 37900 | 4800 | 7.9 | 0.07 | 0 |
| 10 | 40300 | 3800 | 10.6 | 0.2 | 0 |

FIG. 1 is a diagrammatic graph showing GPC data measured with regard to an example of binder resin produced according to the present invention.

In the graph,

"A" indicates the relative intensity at a position corresponding to the molecular weight of 10,000, "B" indicates the relative intensity at a position corresponding to the molecular weight of 100,000, and "C" indicates the relative intensity at a position corresponding to the molecular weight of 1,000,000.

Embodiment 1

Preparation of the Toner

Resin of resin synthesis example 1 91 parts per weight

| | |
|---|---|
| -Carbon black Black pearls 460 (produced by Cabot Specialty Chemicals Incorporated) | 5 parts per weight |
| -Charge control agent (positive charge control agent) Bontron N-04 (produced by Orient Chemical Industries Incorporated) | 2 parts per weight |
| -Wax Viscol 550P (produced by Sanyo Chemical Industries Incorporated) | 2 parts per weight. |

The above were mixed in a Henschell mixer, and were kneaded in a two-axle kneader. The kneaded mixture obtained in this manner was pulverized and separated to produce a toner raw material A'.

The follow ingredients were mixed in a Henschell mixer:

toner raw material A' described above 100 parts per weight silica HDK3050EP (produced by Clariant Japan Incorporated) 1 part per weight.

This was then sifted to produce a toner A".

Preparation of the Developer

The following ingredients were mixed and agitated to produce a developer A.

| | |
|---|---|
| -Toner A" | 5 parts per weight |
| -Carrier (a silica resin coated ferrite carrier) | 95 parts per weight |

Embodiment 2

A developer B was obtained in the same manner as in embodiment 1, with the exception that in place of the resin of synthesis example 1 in embodiment 1, the resin of synthesis example 2 was employed.

Embodiment 3

A developer C was produced in the same manner as in embodiment 1, with the exception that in place of the resin synthesis example 1 in embodiment 1, the resin of synthesis example 3 was employed.

Embodiment 4

A developer D was prepared in the same manner as in embodiment 1, with the exception that in place of the resin of synthesis example 1 in embodiment 1, the resin of synthesis example 4 was employed.

Embodiment 5

A developer E was produced in the same manner as in embodiment 1, with the exception that in place of the resin of synthesis 1 in embodiment 1, the resin of synthesis example 5 was employed.

Embodiment 6

A developer F was produced in the same-manner as in embodiment 1, with the exception that the following toner raw material was employed.

| | |
|---|---|
| -Resin of resin synthesis example 2 | 100 parts per weight |
| -Carbon black<br>Black pearls 460 (produced by Cabot Specialty Chemicals Incorporated) | 5 parts per weight |
| Charge control agent (positive charge control agent) Bontron N-04 (produced by Orient Chemicals Industries Incorporated) | 1.5 parts per weight |
| Quaternary ammonium salt composition (2-1) | 1.5 parts per weight |
| -Wax<br>Refined carnauba wax number 1 (acid number 5, produced by CERA RICA NODA Incorporated) | two parts per weight |

Thereinafter, in the same way, the developers G, H, I, and J of embodiments 7–10 were produced in accordance with the composition examples for developers of embodiments and comparative examples shown in Table 3, wherein those parts not shown in Table 3 are identical to embodiment 1.

Embodiment 11

| | |
|---|---|
| Resin of resin example 6 | 55 parts per weight |
| -Colorant (magnetic powder)<br>BL-200 (produced by Titanium Industries) | 40 parts per weight |
| -Charge control agent (positive charge control agent) Bontron N-04 (produced by Orient Chemical Industries Incorporated) | 1.5 parts per weight |
| Quaternary ammonium salt composition (2-1) | 1.5 parts per weight |
| -Wax<br>Refined carnauba wax number 1 (acid number 5, produced by CERA RICA NODA Incorporated) | 2 parts per weight |

The above were mixed in a Henschell mixer, and these were kneaded in a two-axle kneader. The kneaded product obtained in this manner was pulverized and separated to produce a toner raw material K.

The following ingredients were mixed:

| | |
|---|---|
| -toner raw material K | 100 parts per weight |
| -silica HDK 3050 EP (produced by Clariant Japan Incorporated) | 1 part per weight. |

Subsequently, this was sifted, and a magnetic single-component developing toner K was obtained.

Comparative Example 1

A comparative developer L was produced in the same manner as that of embodiment 1, with the exception that in place of the resin of synthesis example 1 which was used in embodiment 1, the resin of synthesis example 8 was employed.

Comparative Example 2

A comparative developer M was obtained in accordance with the method of embodiment 1, with the exception that in place of the resin of synthesis example 1 which was used in embodiment 1, the resin of synthesis example 9 was employed.

Comparative Example 3

A comparative developer N was produced in the same manner as that of embodiment 6, with the exception that in place of the resin of synthesis example 6 which was employed in embodiment 6, the resin of synthesis example 10 was employed.

TABLE 3

Synthesis Example Mixtures

| Example | Developer | Resin | WAX | Nigrosine | Quaternary Ammonium Salt | Average Diameter |
|---|---|---|---|---|---|---|
| Embodiment 1 | A | Synthesis example 1, 91 parts | Viscol 550P, 2 parts | N-04, 2 parts | None | 10.2 microns |
| Embodiment 2 | B | Synthesis example 2, 91 parts | Viscol 550P, 2 parts | N-04, 2 parts | None | 10.0 microns |
| Embodiment 3 | C | Synthesis example 3, 91 parts | Viscol 550P, 2 parts | N-04, 2 parts | None | 10.1 microns |
| Embodiment 4 | D | Synthesis example 4, 91 parts | Viscol 550P, 2 parts | N-04, 2 parts | None | 10.0 microns |
| Embodiment 5 | E | Synthesis example 5, 91 parts | Viscol 550P, 2 parts | N-04, 2 parts | None | 10.2 microns |
| Embodiment 6 | F | Synthesis example 2, 100 parts | Carnauba wax, 2 parts | N-04, 1.5 parts | Compound (2-1), 1.5 parts | 10.1 microns |
| Embodiment 7 | G | Synthesis example 2, 100 parts | Carnauba wax, 2 parts | N-04, 1.5 parts | None | 10.4 microns |
| Embodiment 8 | H | Synthesis example 6, 100 parts | Carnauba wax, 2 parts | N-04, 1.5 parts | Compound (2-1), 1.5 parts | 10.0 microns |
| Embodiment 9 | I | Synthesis example 6, 100 parts | Carnauba wax, 2 parts | N-04, 1.5 parts | None | 10.1 microns |
| Embodiment 10 | J | Synthesis example 7, 100 parts | Carnauba wax, 2 parts | N-04, 1.5 parts | Compound (1-1), 1.5 parts | 10.2 microns |

TABLE 3-continued

Synthesis Example Mixtures

| Example | Developer | Resin | WAX | Nigrosine | Quaternary Ammonium Salt | Average Diameter |
|---|---|---|---|---|---|---|
| Embodiment 11 | K | Synthesis example 6, 55 parts | Carnauba wax, 2 parts | N-04, 1.5 parts | Compound (2-1), 1.5 parts | 10.2 microns |
| Comparative Example 1 | L | Synthesis example 8, 91 parts | Viscol 550P, 2 parts | N-04, 2 parts | None | 10.0 microns |
| Comparative Example 2 | M | Synthesis example 9, 91 parts | Viscol 550P, 2 parts | N-04, 2 parts | None | 10.1 microns |
| Comparative Example 3 | N | Synthesis example 10, 100 parts | Carnuba wax, 2 parts | N-04, 1.5 parts | Compound (2-1), 1.5 parts | 10.5 microns |

*Aside from embodiment 11, 5 parts per weight of Black Pearls 460 (produced by Cabot Specialty Chemicals Ink) were added to the developer as a colorant.

With respect to the wax, the following products were employed.

Carnauba wax: carnauba wax number 1 (acid number 5), produced by CERA RICA NODA Limited.

Montan wax: Hoechst Wax E (acid number 20), produced by Clariant Japan Limited.

Viscol 550P: polypropylene wax produced by Sanyo Chemicals.

With respect to the developers obtained in the embodiments and comparative examples described above, the fixation initiation temperature, the hot offset initiation temperature, and printing tests were as described below.

Heat Roller Fixation/Offset Property Evaluation

An A4 paper size unfixed image sample was produced using a commercially available remodeled two-component type copier, and using a heat roller fixation unit of the type described below, the fixation initiation temperature and the presence or absence of the offset phenomenon were evaluated under the following three types of test conditions.

With respect to the toner of embodiment 11, a commercially available magnetic single component developing printer was remodeled and a unfixed image sample was produced.

| | |
|---|---|
| Roller material | Upper: tetrafluoroethylene<br>Lower: HTV silicon |
| Roller shape | Diameter: 50 mm<br>Length: 370 mm |
| Upper roller load: | 15 kg |
| Upper/lower roller nip width: | 8 mm |
| (Conditions A) | |
| Upper roller load: | 15 kg |
| Upper/lower roller nip width: | 8 mm |
| Paper feed rate: | 300 mm/sec |
| (Conditions B) | |
| Upper roller load: | 15 kg |
| Upper/lower roller nip width: | 8 mm |
| Paper feed rate: | 350 mm/sec |
| (Conditions C) | |
| Upper roller load: | 25 kg |
| Upper/lower roller nip width: | 10 mm |
| Paper feed rate: | 800 mm/sec |

The fixation strength was determined from the image density residual ratio calculated by the formula given below. The image density was evaluated using a Macbeth image densitometer RD-918.

Image Density Residual Ratio=Image Density After the Fastness Test/Image Density Before the Fastness Test Here, what is meant by the image density after the fastness test is an image density of the fixed image measured using Macbeth image densitometer RD-918 after rubbed by a vibration-type abrasion fastness testing apparatus (load: 200 g. abrasion operation: 5 strokes).

Using as the fixation strength a level which will cause no problems in actual operation, a residual ratio of 80% or more, the minimum temperature was employed as the fixation initiation temperature. The offset initiation temperature was determined to be the temperature at which the offset phenomenon was visually confirmed when observing a fixed image sample.

The results thereof are shown in Table 4.

TABLE 4

Evaluation Results 1.

| | Conditions A | | Conditions B | | Conditions C | |
|---|---|---|---|---|---|---|
| | Fixation Initiation Temperature ° C. | Offset Initiation Temperature ° C. | Fixation Initiation Temperature ° C. | Offset Initiation Temperature ° C. | Fixation Initiation Temperature ° C. | Offset Initiation Temperature ° C. |
| Embodiment 1 | 125 | 245 | 125 | 245 | 145 | 225 |
| Embodiment 2 | 120 | 250 | 120 | 250 | 140 | 230 |
| Embodiment 3 | 120 | 245 | 125 | 245 | 140 | 225 |
| Embodiment 4 | 125 | 245 | 125 | 240 | 145 | 220 |
| Embodiment 5 | 130 | 240 | 130 | 240 | 145 | 220 |
| Embodiment 6 | | | 105 | 255 | 130 | 230 |
| Embodiment 7 | | | 105 | 250 | 130 | 230 |
| Embodiment 8 | | | | | 120 | 245 |
| Embodiment 9 | | | | | 125 | 245 |
| Embodiment 10 | | | | | 120 | 245 |
| Embodiment 11 | | | | | 125 | 240 |
| Comparative Example 1 | 135 | 220 | 135 | 220 | 150 | 215 |
| Comparative Example 2 | 140 | 200 | 145 | 200 | 155 | 185 |
| Comparative Example 3 | | | | | 145 | 205 |

Printing Test

The printing quality resulting from continuous printing using a commercially available laser beam printer (equipped with-a selenium photosensitive medium) was evaluated, and the amount of charge of the developer was measured. The replenishment of toner during continuous printing was automatically conducted by filling the toner replenishment hopper of the machine with toner after the addition of silica.

The amount of charge was measured by means of a blowoff charge amount measuring apparatus. The image density was measured using a Macbeth densitometer RD-918, while fogging (=background) was determined from the difference between the white background image density and the white paper density prior to printing.

With respect to the toner of embodiment 11, a commercially available magnetic single-component developing printer was remodeled and a test was conducted. With respect to the amount of charge, toner was recovered from the interior of the developing apparatus after each copied page, and a developer was produced in which the toner/carrier (a silicone resin-coated ferrite carrier) was 5/95 (weight ratio) and measurement was otherwise conducted as with other two-component developers.

Resistance to Abrasion of the Printed Image

An unfixed image sample produced by the remodeled test apparatus described above was fixed by means of the fixing apparatus described above under conditions C at a temperature of 160° C., and the resistance to-abrasion was evaluated by determining the image density residual ratio when the fixed image was subjected to abrasion by the method described below.

Image Density Residual Ratio=Image Density After the Fastness Test/Image Density Before the Fastness Test The image density was with using a Macbeth densitometer RD-918.

Here, what is meant by the image density after the fastness test is an image density remaining after the abrasion of the fixed image measured using a vibration-type abrasion fastness testing apparatus (load: 200 g, abrasion operation: 10 strokes).

With respect to the resistance to abrasion, a residual ratio of 95% or more is indicated by ⊕, less than 95%–90% is indicated by O, less than 90%–80% is indicated by Δ, and less than 80% is indicated by X.

Amount of Toner Dispersion

The interior of the machine was inspected after printing 50 kP (50,000 pages), and the amount of contamination by dispersed toner on the photosensitive medium and the peripheral parts of the developing apparatus was evaluated; when there was almost no such contamination, this is indicated by O, some contamination is indicated by Δ, and severe contamination is indicated by X.

The results of the evaluations described above are shown in Table 5.

TABLE 5

Evaluation Results 2.

| Printing Test | Initial | 10 kP | 20 kP | 30 kP | 40 kP | 50 kP | Resistance to Abrasion | Toner Dispersion |
|---|---|---|---|---|---|---|---|---|
| Embodiment 1 | | | | | | | | |
| Charge Amount | 18 | 16 | 18 | 17 | 16 | 17 | ⊕ | Δ |
| Image Density | 1.5 | 1.4 | 1.3 | 1.5 | 1.5 | 1.4 | | |
| Fogging | ○ | ○ | ○ | ○ | ○ | ○ | | |
| Embodiment 2 | | | | | | | | |
| Charge Amount | 17 | 19 | 18 | 20 | 18 | 19 | ⊕ | Δ |
| Image Density | 1.4 | 1.5 | 1.4 | 1.5 | 1.4 | 1.5 | | |
| Fogging | ○ | ○ | ○ | ○ | ○ | | | |
| Embodiment 3 | | | | | | | | |
| Charge Amount | 16 | 18 | 18 | 19 | 17 | 18 | ⊕ | Δ |
| Image Density | 1.5 | 1.4 | 1.5 | 1.5 | 1.4 | 1.4 | | |
| Fogging | ○ | ○ | ○ | ○ | ○ | ○ | | |

TABLE 5-continued

Evaluation Results 2.

| Printing Test | Initial | 10 kP | 20 kP | 30 kP | 40 kP | 50 kP | Resistance to Abrasion | Toner Dispersion |
|---|---|---|---|---|---|---|---|---|
| Embodiment 4 | | | | | | | | |
| Charge Amount | 19 | 17 | 17 | 18 | 17 | 18 | ⊕ | Δ |
| Image Density | 1.5 | 1.4 | 1.4 | 1.5 | 1.3 | 1.4 | | |
| Fogging | ○ | ○ | ○ | ○ | ○ | ○ | | |
| Embodiment 5 | | | | | | | | |
| Charge Amount | 18 | 17 | 17 | 18 | 16 | 17 | ⊕ | Δ |
| Image Density | 1.5 | 1.4 | 1.5 | 1.5 | 1.4 | 1.4 | | |
| Fogging | ○ | ○ | ○ | ○ | ○ | ○ | | |
| Embodiment 6 | | | | | | | | |
| Charge Amount | 18 | 19 | 19 | 20 | 18 | 19 | ⊕ | ○ |
| Image Density | 1.5 | 1.5 | 1.4 | 1.4 | 1.5 | 1.5 | | |
| Fogging | ○ | ○ | ○ | ○ | ○ | ○ | | |
| Embodiment 7 | | | | | | | | |
| Charge Amount | 20 | 21 | 22 | 20 | 19 | 18 | ⊕ | Δ |
| Image Density | 1.2 | 1.2 | 1.1 | 1.1 | 1.2 | 1.3 | | |
| Fogging | ○ | ○ | ○ | ○ | Δ | Δ | | |
| Embodiment 8 | | | | | | | | |
| Charge Amount | 19 | 19 | 18 | 20 | 19 | 19 | ○ | ○ |
| Image Density | 1.5 | 1.5 | 1.5 | 1.4 | 1.5 | 1.4 | | |
| Fogging | ○ | ○ | ○ | ○ | ○ | ○ | | |
| Embodiment 9 | | | | | | | | |
| Charge Amount | 20 | 22 | 20 | 20 | 18 | 18 | ○ | Δ |
| Image Density | 1.3 | 1.2 | 1.2 | 1.1 | 1.2 | 1.3 | | |
| Fogging | ○ | ○ | ○ | ○ | Δ | Δ | | |
| Embodiment 10 | | | | | | | | |
| Charge Amount | 18 | 20 | 19 | 18 | 19 | 18 | ○ | ○ |
| Image Density | 1.5 | 1.5 | 1.4 | 1.5 | 1.5 | 1.4 | | |
| Fogging | ○ | ○ | ○ | ○ | ○ | ○ | | |
| Embodiment 11 | | | | | | | | |
| Charge Amount | 18 | 17 | 19 | 18 | 19 | 18 | ○ | ○ |
| Image Density | 1.4 | 1.4 | 1.5 | 1.4 | 1.5 | 1.4 | | |
| Fogging | ○ | ○ | ○ | ○ | ○ | ○ | | |
| Comparative Example 1 | | | | | | | | |
| Charge Amount | 18 | 15 | 17 | 14 | 12 | 11 | ○ | X |
| Image Density | 1.5 | 1.4 | 1.5 | 1.3 | 1.2 | 1.1 | | |
| Fogging | ○ | ○ | ○ | ○ | Δ | X | | |
| Comparative Example 2 | | | | | | | | |
| Charge Amount | 16 | 17 | 13 | 11 | 10 | 10 | X | X |
| Image Density | 1.5 | 1.5 | 1.3 | 1.2 | 1.2 | 1.1 | | |
| Fogging | ○ | ○ | ○ | Δ | X | X | | |
| Comparative Example 3 | | | | | | | | |
| Charge Amount | 18 | 19 | 18 | 19 | 19 | 18 | X | ○ |
| Image Density | 1.5 | 1.5 | 1.5 | 1.4 | 1.5 | 1.4 | | |
| Fogging | ○ | ○ | ○ | ○ | ○ | ○ | | |

The results indicated in the table are explained hereinbelow.

"Charge Amount": $\mu$C/g

"Fogging": O: less than 0.01, Δ: 0.01—less than 0.03, X: 0.03 or more

"Toner Dispersion": visual evaluation after printing 50 kP (50,000 pages)

O: Almost no dispersion

Δ: Some contamination as a result of dispersion

X: Severe contamination

As is clear from Table 4, when the developer employing the polyester resin of the present invention is used, fixation occurs at a lower temperature, and the anti-offset properties at higher temperatures are superior in comparison with the developers of comparative example 1, in which the epoxy compound was reacted after formation of the polyester main chain, and of comparative examples 2 and 3, which contained no epoxy crosslinking agent. Furthermore, as is clear from Table 5, even in the continuous printing test, the developer employing the polyester resin of the present invention exhibited stable charge behavior, and there was no fogging, and printing of sufficient image density could be conducted. On the other hand, when the developers of comparative example 1 and comparative example 2 were employed, the amount of charge decreased as the number of pages printed increased, and a decline in image density and the occurrence of fogging were observed. Binder components of the toner were deposited on the surface of the carrier after the printing of 50 kP (50,000 pages), and the occurrence of spent carrier was observed, while contamination resulting from toner dispersion was confirmed within the machine on the photosensitive medium and on the peripheral parts of the developing apparatus.

Furthermore, among the embodiments of the present invention, embodiments 6, 8, 10, and 11, in which quaternary ammonium salt compounds and a nigrosine charge control agent were employed together, and which employed special natural wax, exhibited the most stable charge behavior during 50 kP printing. Furthermore, when the interior of the machine was observed after the printing of 50 kP (50,000 pages.), although there was a slight amount of contamination resulting from toner dispersion onto the photosensitive medium and the peripheral parts of the developing apparatus when other embodiments were employed, when embodiments 6, 8, 10, and 11 were employed, there was absolutely no dispersion of the toner. Furthermore, in comparing embodiments 6 and 2, which employed the same resin, embodiment 6 exhibited an improvement in fixation properties and anti-offset properties.

What is claimed is:

1. A toner composition for electrostatic image developing containing colored resin particles comprising at least a binder resin, a colorant, and a charge control agent, said binder comprises:

(1) an epoxy compound with a valence of 5 or more, (2) a polybasic acid compound having a valence of 2 or more selected from the group consisting of a polybasic acids and/or acid anhydrides and/or lower alkyl esters thereof, (3) a polyvalent alcohol having a valance of 2 or more, and said binder resin is produced by reacting components (1)–(3) simultaneously, or by first reacting components (1) and (3), and subsequently reacting component (2), or by first reacting components (1) and (2), and subsequently reacting component (3).

2. A toner composition for electrostatic image development in accordance with claim 1, wherein said polyvalent alcohol having a valence of 2 or more contains polyoxypropylene-bis(4-hydroxyphenyl) propane.

3. A toner composition for electrostatic image development in accordance with claim 1, wherein said polyvalent alcohol having a valence of 2 or more comprises an aliphatic polyvalent alcohol having a valence of 2 or more.

4. A toner composition for electrostatic image developing containing colored resin particles comprising at least a binder resin, a colorant, a charge control agent, and a releasing agent, wherein (1) an epoxy compound with a valence of 5 or more, (2) a polybasic acid compound having a valence of 2 or more selected from the group consisting of polybasic acids and/or acid anhydrides and/or lower alkyl esters thereof, and (3) polyoxypropylene-bis(4-hydroxyphenyl) propane, are employed as chief structural components of said binder resin, a polyester resin is produced by reacting components (1)–(3) simultaneously, or by first reacting components (1) and (3), and subsequently reacting component (2), or by first reacting components (1) and (2), and subsequently reacting component (3). and said releasing agent contains at least one of carnauba wax, montan ester wax, rice wax and/or scale insect wax.

5. A toner composition for electrostatic image developing containing colored resin particles comprising at least a binder resin, a colorant, a charge control agent, and a releasing agent, wherein (1) an epoxy compound with a valence of 5 or more, (2) a polybasic acid compound having a valence of 2 or more selected from the group consisting of polybasic acids and/or acid anhydrides and/or lower alkyl esters thereof, and (3) an aliphatic polyvalent alcohol having a valence of 2 or more, are employed as chief structural components of said binder resin, a polyester resin is produced by reacting components (1)–(3) simultaneously, or by first reacting components (1) and (3), and subsequently reacting component (2), or by first reacting components (1) and (2), and subsequently reacting component (3), and said releasing agent contains at least one of carnauba wax, montan ester wax, rice wax and/or scale insect wax.

6. A toner composition for electrostatic image development in accordance with one of claims 1, 4, and 5, wherein the glass transition temperature of said binder resin Is within a range of 55° C.–85° C., and the softening point thereof is within a range of 90° C.–180° C.

7. A toner composition for electrostatic image development in accordance with one of claims 1, 4, and 5, wherein said polybasic acid compound comprises a non-addition polymerizable polybasic acid compound.

8. A toner composition for electrostatic image development in accordance with one of claims 1, 4, and 5, wherein said polybasic acid compound comprises an addition polymerizable polybasic acid compound.

9. A toner composition for electrostatic image development in accordance with one of claims 1, 2, 3, 4, and 5, wherein a ratio ($M_w/M_n$) of the weight average molecular weight ($M_w$) as measured by gel permeation chromatography (GPC) and the numerical average molecular weight ($M_n$) of said polyester resin is 10 or more, and/or a ratio ($I_{10}/I_{01}$) of the relative strength ($I_{10}$) at a position corresponding to a molecular weight of 100,000 in polystyrene conversion as measured by gel permeation chromatography (GPC) and the relative strength ($I_{01}$) at a position corresponding to a molecular weight corresponding to 10,000 is within a range of 0.1–0.4.

10. A toner composition for electrostatic image development in accordance with one of claims 1, 2, 3, 4, and 5, wherein a ratio ($M_w/M_n$) of the weight average molecular weight ($M_w$) as measured by gel permeation chromatography (GPC) and the numerical average molecular weight ($M_n$) of said polyester resin is within a range of 15–60, and/or a ratio ($I_{10}/I_{01}$) of the relative strength ($I_{10}$) at a position corresponding to a molecular weight of 100,000 in polystyrene conversion as measured by gel permeation chromatography (GPC) and the relative strength ($I_{01}$) at a position corresponding to a molecular weight corresponding to 10,000 is within a range of 0.1–0.4.

11. A toner composition for electrostatic image development in accordance with one of claims 1, 2, 3, 4, and 5, wherein a ratio ($M_w/M_n$) of the weight average molecular weight ($M_w$) as measured by gel permeation chromatography (GPC) and the numerical average molecular weight ($M_n$) of said polyester resin is 10 or more, a ratio ($I_{10}/I_{01}$) of the relative strength ($I_{10}$) at a position corresponding to a molecular weight of 100,000 in polystyrene conversion as measured by gel permeation chromatography (GPC) and the relative strength ($I_{01}$) at a position corresponding to a molecular weight corresponding to 10,000 is within a range of 0.1–0.4, and furthermore, the ratio ($I_{100}/I_{01}$) between the relative strength ($I_{100}$) at a position corresponding to a molecular weight of 1,000,000 in polystyrene conversion and the relative strength ($I_{01}$) at a position corresponding to a molecular weight of 10,000 is within a range of 0.05–0.3.

12. A toner composition for electrostatic image development in accordance with one of claims 1, 2, 3, 4, and 5, wherein said charge control agent contains at least a positive charge type nigrosine dye and a quaternary ammonium salt compound.

13. A toner composition for electrostatic image development in accordance with one of claims 1, 2, 3, 4, and 5, wherein said charge control agent comprises at least one selected from the-group consisting of the quaternary ammonium salt compounds in (1) and (2) below:

Compound (1)

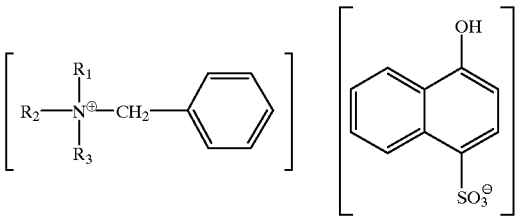

(In the formula, $R_1$–$R_3$ indicate $C_nH_{2n+1}$ groups. Here, n is an integer within a range of 1–10, and $R_1$–$R_3$ may differ)

Compound (2)

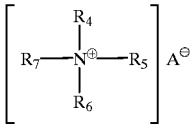

(In the formula, $R_4$, $R_5$, $R_6$, and $R_7$ represent, respectively and independently, a hydrogen atom, an alkyl group or alkenyl group having a number of carbons within a range of 1–22, an unsubstituted or substituted aromatic group having a number of carbons within a range of 1–20, and an aralkyl group having a number of carbons within a range of 7–20, $A^-$ indicates a molybdic acid anion or a tungstic acid anion, or a heteropolyacid anion containing molybdenum or tungsten atoms).

14. A toner composition for electrostatic image development in accordance with one of claims 1, 2, 3, 4, and 5, wherein a resin-coated magnetic carrier is contained which is coated with at least-one resin selected from a group consisting of silicone resin, fluorine resin, and (meth) acrylic resin.

15. A toner composition for electrostatic image development in accordance with one of claims 1, 2, 3, 4, and 5, wherein a magnetic powder is contained as said colorant.

* * * * *